United States Patent [19]

Kwant

[11] 4,165,274

[45] Aug. 21, 1979

[54] PROCESS FOR THE PREPARATION OF SYNTHETIC CRUDE OIL

[75] Inventor: Pieter B. Kwant, Amsterdam, Netherlands

[73] Assignee: Shell Oil Company, Houston, Tex.

[21] Appl. No.: 915,332

[22] Filed: Jun. 13, 1978

[51] Int. Cl.[2] ..... C10G 37/04

[52] U.S. Cl. ..... 208/93; 208/80; 208/86; 208/92

[58] Field of Search ..... 208/80, 86, 92, 93

[56] References Cited

U.S. PATENT DOCUMENTS 4,062,758 12/1977 Goudriaan ..... 208/58

*Primary Examiner*—Herbert Levine

[57] ABSTRACT

Process for treatment of tars and oil, the process being characterized by distillation of the oil to form a vacuum distillate and vacuum residue, hydrocracking of the distillate, deasphalting of the residue, and hydrodemetallizing and hydrodesulphurizing the deasphalted residue.

2 Claims, No Drawings

PROCESS FOR THE PREPARATION OF SYNTHETIC CRUDE OIL

BACKGROUND OF THE INVENTION

Tar sand occurs on a very large scale in nature, for instance in Canada, Venezuela, the United States, Russia and Rumania. It contains about 10%w of heavy hydrocarbon oil which may be obtained from it by extraction. This "tar sand oil" has a high viscosity and a high content of oxygen, sulphur and metal compounds, especially vanadium and nickel compounds.

In view of the increasing demand for crude petroleum oil and the strongly increased price thereof, there is a great interest in processes which offer the possibility to convert, in an economically acceptable way, heavy hydrocarbon oils such as tar sand oils into hydrocarbon mixtures of which the boiling point distribution shows much resemblance to that of crude petroleum oil. Such hydrocarbon mixtures will be further referred to herein as "synthetic crude oils".

Since the boiling point distribution of tar sand oil shows some resemblance to that of an atmospheric distillation residue of a crude petroleum oil, investigation has first focused on the extent known processes for the preparation of synthetic crude oil from atmospheric distillation residues of crude petroleum oil are suitable for application to tar sand oil. In view of the high metal content of tar sand oil, the investigation was first concentrated on a process which yielded excellent results in the preparation of synthetic crude oil from an atmospheric distillation residue of a crude petroleum oil having a high metal content. In this process, the atmospheric distillation residue is first separated by vacuum distillation into a vacuum distillate and a vacuum residue. The vacuum residue is subsequently separated by deasphalting into a deasphalted oil and asphalt. Finally, the vacuum distillate and the deasphalted oil are blended and from the mixture a synthetic crude oil is prepared by subjecting the mixture successively to catalytic hydrodemetallization and catalytic hydrocracking. Application of the above-described process, which will further be referred to as the "standard conversion process", to a tar sand oil instead of to an atmospheric distillation residue of a crude petroleum oil, yields a synthetic crude oil. However, the results are insufficient on certain points. Deficiencies include the yield of $C_5+$ product, the hydrogen consumption, the stability of the hydrocracking operation and the sulphur content, and the viscosity and the boiling point distribution of the 180° C.+ product.

Continued investigation into the preparation of synthetic crude oil from tar sand oil has shown that a much more attractive result can be obtained if certain deviations from the standard conversion process are made. Instead of a mixture of the vacuum distillate and the deasphalted oil being subjected to a hydrogen treatment, the two oils are hydrotreated separately. The vacuum distillate is catalytically hydrocracked without previous demetallization. The deasphalted oil is not cracked but is first catalytically hydrodemetallized and thereafter catalytically hydrodesulphurized.

If the results obtained with the process now proposed are compared with those of the standard conversion process, it appears that the process now proposed (a) gives a higher yield of $C_5+$ product, (b) consumes less hydrogen, (c) shows a more stable hydrocracking operation, and (d) gives a 180° C.+ product with a lower viscosity and sulphur content as well as a more attractive boiling point distribution.

SUMMARY OF THE INVENTION

Accordingly, the present invention relates to a process for treating tar sand oil, in which the tar sand oil is separated by vacuum distillation into a vacuum distillate and a vacuum residue, the vacuum distillate is catalytically hydrocracked, the vacuum residue is separated by deasphalting into a deasphalted oil and asphalt, and the deasphalted oil is first catalytically hydrodemetallized and thereafter catalytically hydrodesulphurized.

In the process according to the invention the vacuum residue is separated by deasphalting into a deasphalted oil and asphalt. The deasphalting is carried out by contacting the residue at elevated temperature and pressure with an excess of a lower hydrocarbon as solvent. The preferred solvent is pentane.

In the process according to the invention the vacuum distillate is catalytically hydrocracked. The hydrocracking is carried out by contacting the distillate at elevated temperature and pressure and in the presence of hydrogen with a suitable hydrocracking catalyst. Preferably, the hydrocracking is carried out as a two-step process, the hydrocracking treatment proper, which takes place in the second step, being preceded by a catalytic hydrotreatment with the main object of reducing the nitrogen and polyaromatics content of the vacuum distillate to be hydrocracked. Suitable catalysts for use in the one-step hydrocracking process as well as in the second step of the two-step hydrocracking process are moderately acidic and strongly acidic catalysts which contain one or more metals with hydrogenating activity on a carrier.

Examples of suitable catalysts for use in the one-step hydrocracking process are fluorine-containing sulphidic catalysts comprising nickel and/or cobalt and in addition molybdenum and/or tungsten on alumina or amorphous, silica-alumina as carrier. Examples of suitable catalysts for use in the second step of the two-step hydrocracking process are fluorine-containing sulphidic catalysts comprising nickel and/or cobalt and in addition molybdenum and/or tungsten on amorphous silica-alumina as carrier, sulphicid catalysts containing or not containing fluorine, and comprising nickel and/or cobalt and in addition molybdenum and/or tungsten on crystalline silica-alumina as carrier, and catalysts, containing or not containing fluorine and comprising one or more noble metals from Group VIII, and in particular palladium, on crystalline silica-alumina as carrier. Suitable catalysts for use in the first step of the two-step hydrocracking process are weakly acidic and moderately acidic catalysts comprising one or more metals with hydrogenating activity on a carrier, such as fluorine-containing sulphidic catalysts comprising nickel and/or cobalt and in addition molybdenum and/or tungsten on alumina or amorphous silica-alumina as carrier. A preferred catalyst combination to be applied in the two-step hydrocracking process consists of a fluorine- and phosphorus-containing nickel-molybdenum catalyst on an alumina carrier as a first-stage catalyst, and a nickel-tungsten catalyst on a low-sodium Y-sieve carrier as a second-stage catalyst.

If in the process according to the invention the hydrocracking is carried out in one step, the following reaction conditions are preferably applied: a temperature of from 350° to 425° C. and in particular of from 375° to 410° C., a hydrogen partial pressure of from 50 to 300 bar and in particular of from 75 to 150 bar, a space of velocity of from 0.25 to 5 $l.l^{-1}.h^{-1}$ and in particular of from 0.25 to 2 $l.l^{-1}.h^{-1}$ and a hydrogen-/oil ratio of from 500 to 3000 $Nl.kg^{-1}$ and in particular of from 1000 to 2500 $Nl.kg^{-1}$. If in the process according to the invention the hydrocracking is carried out in two steps, the following reaction conditions are preferably applied in the first step: a temperature of 325° to 425° C. and in particular of from 350° to 410° C., a hydrogen partial pressure of from 50 to 300 bar and in particular of from 75 to 150 bar, a space velocity of from 0.1-7.5 $l.l^{-1}.h^{-1}$ and in particular of from 0.5-5.0 $l.l^{-1}.h^{-1}$ and a hydrogen/oil ratio of from 500 to 3000 $Nl.kg^{-1}$. In the second step substantially the same conditions are preferably applied as indicated hereinbefore for the one-step process, with the exception of the temperature, which in this case should preferably be 300°-400° C. and particular 320°-380° C. If the hydrocracking is carried out according to the two-step process the whole reaction product from the first step (without ammonia, hydrogen sulphide or other volatile components being separated therefrom) is preferably used as feed for the second step (hydrocracking according to the "series flow" principle).

In the process according to the invention the deasphalted oil is first catalytically hydrodemetallized and thereafter catalytically hydrodesulphurized. The hydrodemetallization and the hydrodesulphurization are carried out by contacting the deasphalted oil and the demetallized deasphalted oil, respectively, at elevated temperature and pressure and in the presence of hydrogen with a suitable hydrodemetallization and hydrodesulphurization catalyst, respectively. Preferred hydrodemetallization catalysts are catalysts more than 80%w of which consist of silica. An especially preferred hydrodemetallization catalyst comprises the metal combination nickel-vanadium on silica as carrier. Preferred hydrodesulphurization catalysts contain nickel and/or cobalt and in addition molybdenum and-/or tungsten on a carrier. An especially preferred hydrodesulphurization catalyst comprises the metal combination cobalt-molybdenum on alumina as carrier. Both the hydrodemetallization and the hydrodesulphurization are preferbly carried out at a temperature of from 300° to 475° C. and in particular of from 350° to 450° C., a hydrogen partial pressure of from 50 to 250 bar and in particular of from 75 to 200 bar, a space velocity of from 0.1 to 25 $l.l^{-1}.h^{-1}$ and in particular of from 0.2 to 10 $l.l^{-1}.h^{-1}$ and a hydrogen/oil ratio of from 100 to 2000 $Nl.kg^{-1}$, and in particular of from 200 to 1500 $Nl.kg^{-1}$.

The hydrocracking, the hydrodemetallization and hydrodesulphurization are preferably carried out by passing the oil concerned at elevated temperature and pressure and in the presence of hydrogen in upward, downward or radial direction through one or more vertically arranged reactors containing a fixed or moving bed of the catalyst concerned. If desired, the hydroprocesses may also be carried out by suspending the catalysts in the oil to be hydroprocessed (hydroprocessing according to the "slurry phase" principle). The hydrocracking and the hydrodesulphurization are more preferably carried out in a conventional fixed bed. A preferred embodiment of the hydrodemetallization is one in which the oil is passed through a vertically arranged bed of the hydrodemetallization catalyst in which during operation fresh catalyst is periodically introduced at the top of the bed and spent catalyst withdrawn at the bottom thereof (hydrodemtallization according to the "bunker flow" principle). Another very attractive embodiment of the hydrodemetallization process is one in which several reactors containing fixed beds of the hydrodemetallization catalyst are present, which reactors are alternatively used for demetallization; while the demetallization is being carried out in one or more of these reactors, the catalyst is replenished in the other reactors (hydrodemetallization according to the "fixed bed swing" principle).

The invention will now further be illustrated with reference to the following example.

EXAMPLE 100 pbw of a tar sand oil were separated by vacuum distillation into 51.3 pbw of a vacuum distillate and 48.7 pbw of a vacuum residue. The vacuum residue was separated by pentane deasphalting into 25.7 pbw deasphalted oil and 23.0 pbw pentane asphalt. Some properties of the vacuum distillate, the deasphalted oil and the blend thereof are given in Table A.

Table A

| | Vacuum distillate | Deasphalted oil | Blend of vacuum distillate and deasphalted oil |
|---|---|---|---|
| Yield on tar sand oil, %w | 51.3 | 25.7 | 77.0 |
| Sulphur content, %w | 2.95 | 5.3 | 3.81 |
| Nitrogen content, %w | 0.15 | 0.48 | 0.26 |
| $V_{\kappa_{210}}$, cSt | 7.8 | 1780 | 29.9 |
| Vanadium content, ppmw | 2.0 | 105 | 37 |
| Nickel content, ppmw | 0.9 | 42 | 14 |

EXPERIMENT 1 (standard conversion process)

In this experiment the blend of vacuum distillate and deasphalted oil was successively hydrodemetallized and hydrocracked. The experiment was carried out at a total pressure of 140 bar, a hydrogen partial pressure of 120-125 bar and a recycle gas rate of 1000 $Nl.kg^{-1}$. The hydrodemetallization was carried out at an average temperature of 401° C. and a space velocity of 1.56 $l.l^{-1}.h^{-1}$ over a fixed bed of a $Ni/V/SiO_2$ catalyst comprising 0.5 pbw nickel and 2.0 pbw vanadium per 100 pbw silica. The hydrocracking was carried out in one step at an average temperature of 399° C. and a space velocity of 0.69 $l.l^{-1}.h^{-1}$ over a fixed bed of a $Ni/Mo/P/Al_2O_3$ catalyst comprising 3.7 pbw nickel, 14.3 pbw molybdenum and 3.5 pbw phosphorus per 100 pbw alumina which catalyst has been fluorided in situ to a fluorine content of 6%w. Th deactivation of the hydrocracking catalyst amounted to 0.6° C. per 100 hours.

EXPERIMENTS 2-5

In these experiments the vacuum distillate was hydrocracked and the deasphalted oil was successively hydrodemetallized and hydrodesulphurized. The hydrodemetallization and the hydrodesulphurization were carried out at a total pressure of 120 bar, a hydrogen partial pressure of 100 bar, a space velocity of 0.4 $l.l^{-1}.h^{-1}$ and a recycle gas rate of 1000 $Nl.kg^{-1}$. The hydrodemetallization was carried out at an average temperature of 410° C. over a fixed bed of 2 l of the same hydrodemetallization catalyst as applied in experiment 1. The hydrodesulphurization was carried out at an average temperature of 400° C. first over a fixed bed of 4 l of a $Co/Mo/Al_2O_3$ catalyst comprising 3.7 pbw cobalt and 11.0 pbw molybdenum per 100 pbw alumina and thereafter over a fixed bed of 4 l of a $Co/Mo/Al_2O_3$ catalyst comprising 3.8 pbw cobalt and 9.4 pbw molybdenum per 100 pbw alumina. The deactivation of the hydrocracking and hydrodesulphurizing catalysts amounted to less than 0.3° C. per 100 hours.

EXPERIMENT 2

In this experiment the hydrocracking was carried out in one step at a total pressure (=hydrogen partial pressure) of 125 bar, an average temperature of 383° C., a space velocity of 0.57 $l.l^{-1}.h^{-1}$ and a gas rate of 1500 $Nl.kg^{-1}$ over a fixed bed of 300 ml of the same hydrocracking catalyst as applied in experiment 1.

EXPERIMENT 3

In this experiment the hydrocracking was carried out in two steps according to the series flow principle at a total pressure (=hydrogen partial pressure) of 125 bar and a gas rate of 1500 $Nl.kg^{-1}$. The first step was carried out at an average temperature of 392° C. and a space velocity of 2.0 $l.l^{-1}.h^{-1}$ over a fixed bed of 300 ml of the same hydrocracking catalyst as applied in the experiments 1 and 2. The second step was carried out at an average temperature of 360° C. and a space velocity of 3.7 $l.l^{-1}.h^{-1}$ over a fixed bed of 300 ml of a Ni/W/Y-sieve catalyst comprising 3.0 pbw nickel and 9.5 pbw tungsten per 100 pbw carrier composed of 75 pbw zeolite Y with low sodium content and 25 pbw alumina binder. The conditions of the hydrocracking were selected in such a way that the same amount of a $C_5$-180° C. naphtha fraction was obtained as according to experiments 1 and 2.

EXPERIMENT 4

In this experiment the hydrocracking was carried out in substantially the same way as in experiment 3. However, in the present case the second step was carried out at a space velocity of 0.8 $l.l^{-1}.h^{-1}$. The space velocities were selected in such a way that the same overall space velocity was obtained as in the experiments 1 and 2.

EXPERIMENT 5

In this experiment the hydrocracking was carried out in substantially the same way as in experiments 3 and 4. However, in the present case the second step was carried out at a space velocity of 2.0 $l.l^{-1}.h^{-1}$ in order to perform the hydrocracking at a severity between those of the experiments 3 and 4.

The results of the experiments 1–5 are given in Table B.

Table B

| Experiment no. | 1 | 2 | 3 | 4 | 5 |
|---|---|---|---|---|---|
| Product distribution, %w on tar sand oil | | | | | |
| ex vacuum distillate | | | | | |
| $C_5$–180° C. | — | 4.5 | 4.5 | 21 | 9 |
| 180°–370° C. | — | 31 | 21.5 | 23 | 24 |
| 370°–538° C. | — | 14.5 | 23.5 | 5.5 | 16.5 |
| ex deasphlted oil | | | | | |
| 180°–370° C. | — | 4.5 | 4.5 | 4.5 | 4.5 |
| 370° C.–538° C. | — | 7.5 | 7.5 | 7.5 | 7.5 |
| 538° C.+ | — | 13.5 | 13.5 | 13.5 | 13.5 |
| ex vacuum distillate + deasphalted oil | | | | | |
| $C_5$–180° C. | 4.5 | 4.5 | 4.5 | 21 | 9 |
| 180°–370° C. | 31 | 35.5 | 26 | 27.5 | 28.5 |
| 370°–538° C. | 27 | 22 | 31 | 13 | 24 |
| 538° C.+ | 11.5 | 13.5 | 13.5 | 13.5 | 13.5 |
| Composition of the 180° C.+ product, %w | | | | | |
| 180°–370° C. | 44.5 | 50 | 37 | 51 | 43.5 |
| 370°–538° C. | 39 | 31 | 44 | 24 | 36.5 |
| 538° C.+ | 16.5 | 19 | 19 | 25 | 20 |
| Sulphur content of the 180° C.+product, %w | 0.27 | 0.22 | 0.15 | 0.19 | 0.16 |
| $V_{k_{210}}$ of the 180° C.+ product, cSt | 6.60 | 4.98 | 3.88 | 3.39 | 3.65 |
| Overall space velocity, $l.l^{-1}.h^{-1}$ | 0.5 | 0.5 | 0.75 | 0.5 | 0.67 |
| Hydrogen consumption, %w on vacuum distillate + deasphalted oil | 1.8 | 1.6 | 1.5 | 1.8 | 1.6 |

I claim as my invention:

1. A process for treating tar sand oil comprising:
(a) separating the tar sand oil by vacuum distillation into a vacuum distillate and a vacuum residue,
(b) catalytically hydrocracking the vacuum distillate,
(c) separating the vacuum residue by deasphalting into a deasphalted oil and asphalt, and
(d) hydrometallizing the deasphalted oil and thereafter catalytically hydrodesulphurizing the deasphalted oil.

2. The process of claim 1 in which the hydrocracked vacuum distillate of step (b) and the hydrodesulphurized deasphalted oil of step (d) are blended.

* * * * *